United States Patent [19]

Johnson

[11] 4,068,641

[45] Jan. 17, 1978

[54] METERED FUEL INJECTION APPARATUS

[76] Inventor: Dennis L. Johnson, 509 Thurston Ave., Pender, Nebr. 68047

[21] Appl. No.: 663,254

[22] Filed: Mar. 3, 1976

[51] Int. Cl.[2] ..... F02M 37/12; F02M 59/14; F04B 43/06

[52] U.S. Cl. ..... 123/139 A; 417/395

[58] Field of Search ..... 123/139 A, 139 AH, 139 AJ, 123/139 BC; 417/392, 393, 394, 395

[56] References Cited

U.S. PATENT DOCUMENTS

| | | | |
|---|---|---|---|
| 1,816,157 | 7/1931 | Scott | 123/139 AJ |
| 1,956,612 | 5/1934 | Bran | 123/139 A |
| 2,362,822 | 11/1944 | Houser et al. | 123/139 AH |
| 2,803,234 | 8/1957 | Mansfield et al. | 123/139 A |
| 2,816,533 | 12/1957 | Reggio | 123/139 AJ |
| 3,088,448 | 5/1963 | Fleming | 123/139 BC |

FOREIGN PATENT DOCUMENTS

| | | | |
|---|---|---|---|
| 535,905 | 2/1922 | France | 123/139 A |

*Primary Examiner*—Carlton R. Croyle
*Assistant Examiner*—Michael Koczo, Jr.
*Attorney, Agent, or Firm*—George R. Nimmer

[57] ABSTRACT

Disclosed is a novel system and apparatus for metering fuel with a flexural diaphragm-like divider-wall to injector nozzles for multi-cylinders combustion engines, the divider-wall providing a barrier between a fuel-chamber and a hydraulic-chamber and being motivated by circulating hydraulic liquid according to time pulses controlled by an inlet-valve and an outlet-valve, which valves are preferably of the rotary type and located within the housing for the fuel-chambers and hydraulic-chambers. The system and apparatus might have the further capability of delivering a so-called "stratified" fuel charge to the nozzles, by sloping the intensity of each pulse of hydraulic liquid entering the hydraulic-chambers. More sophisticated systems and apparatus are suggested herein according to the exigencies and requirements of the multi-cylinders engine and its environment.

8 Claims, 6 Drawing Figures

FIG. 2
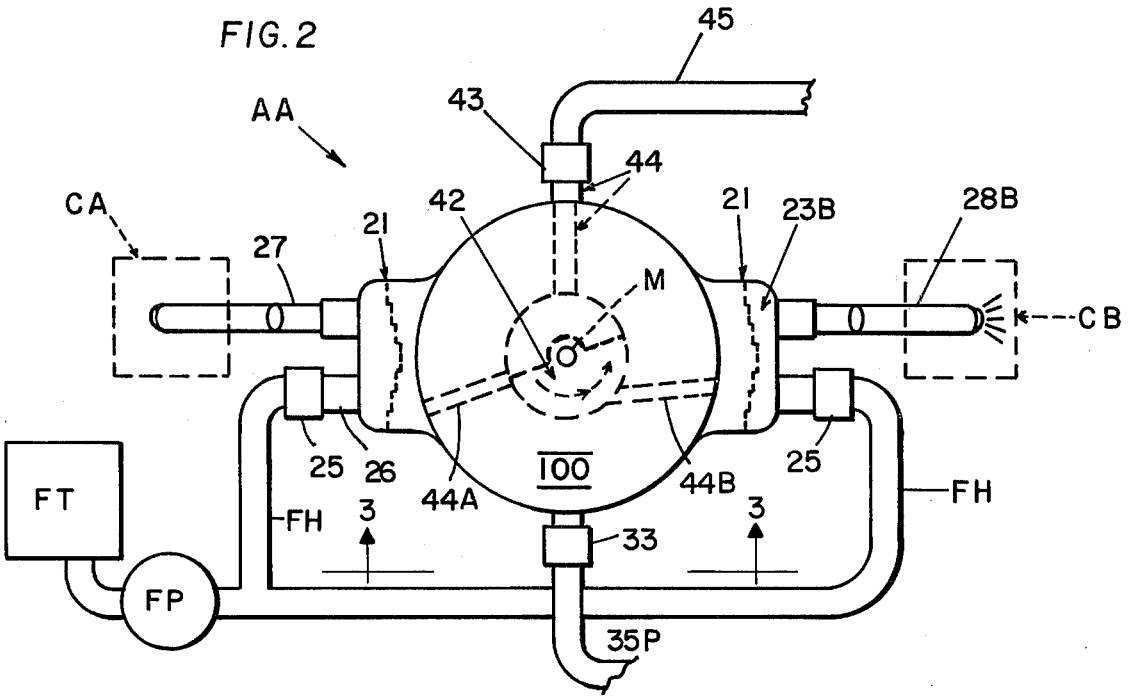
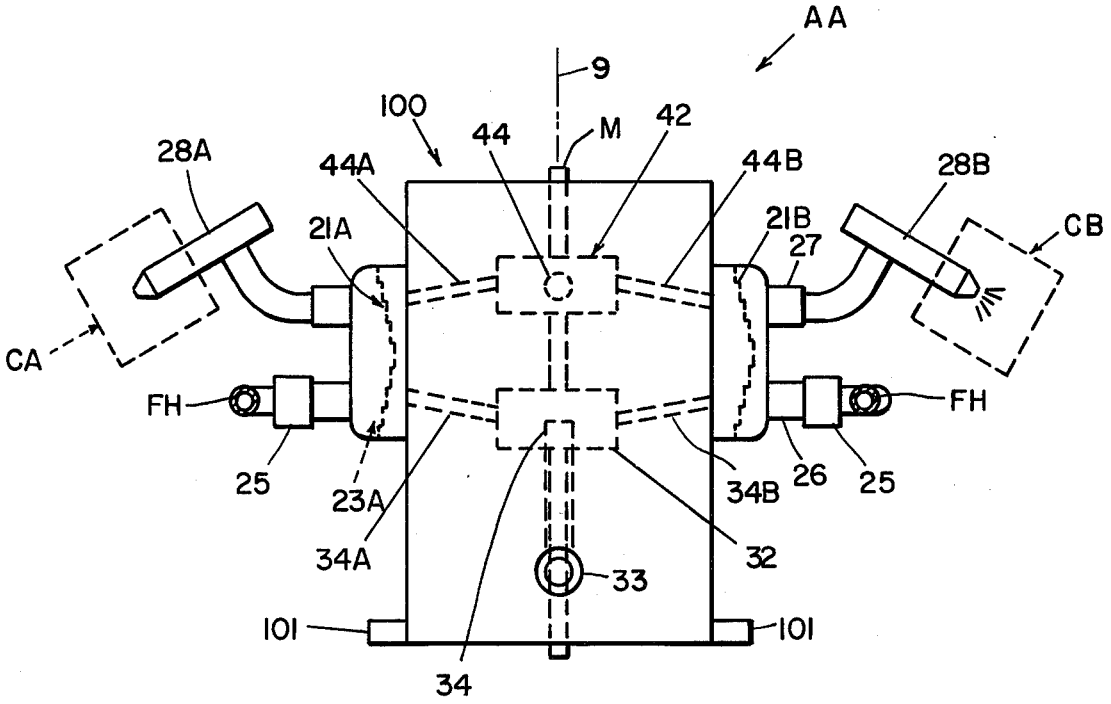
FIG. 3

FIG. 4
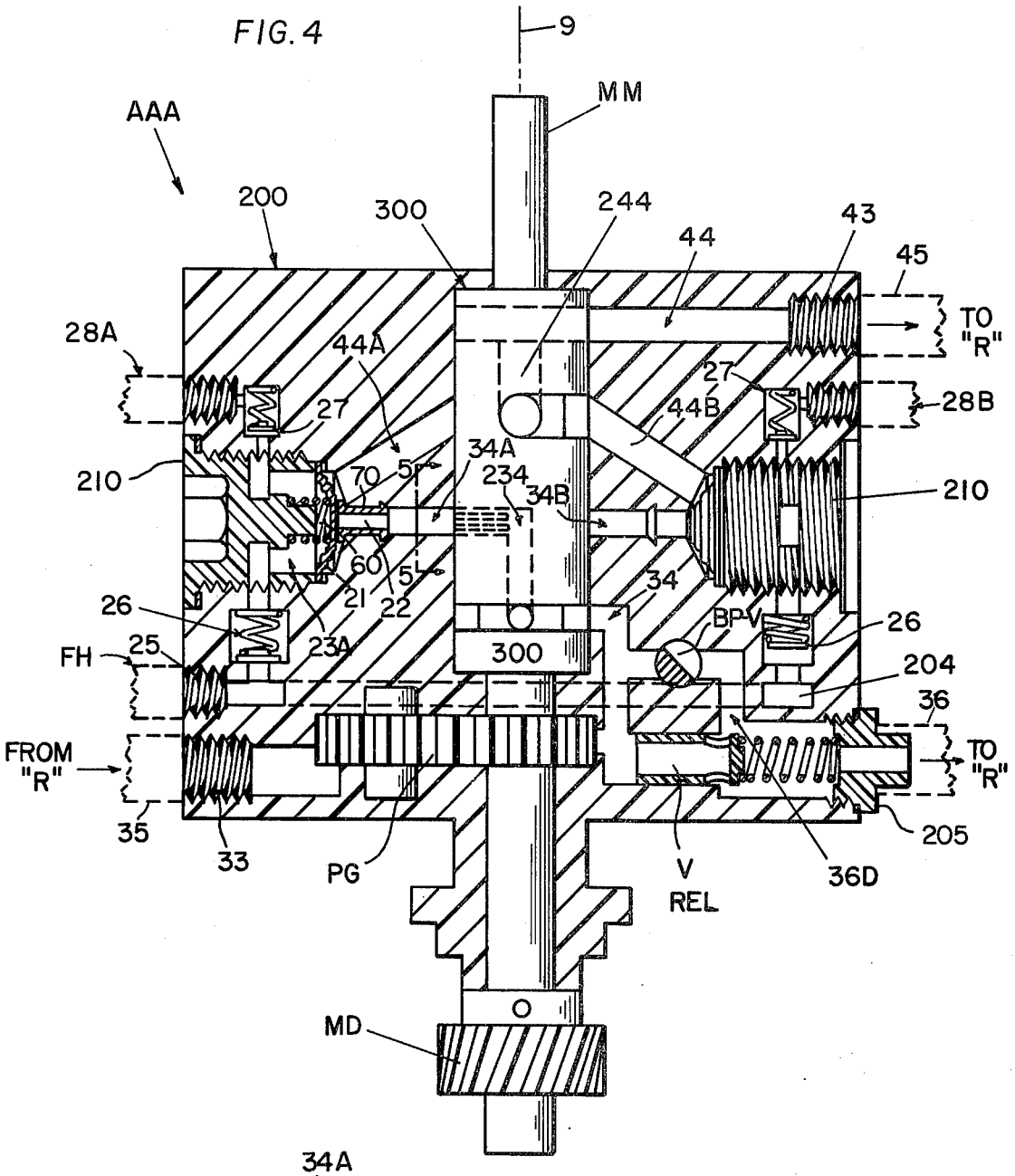
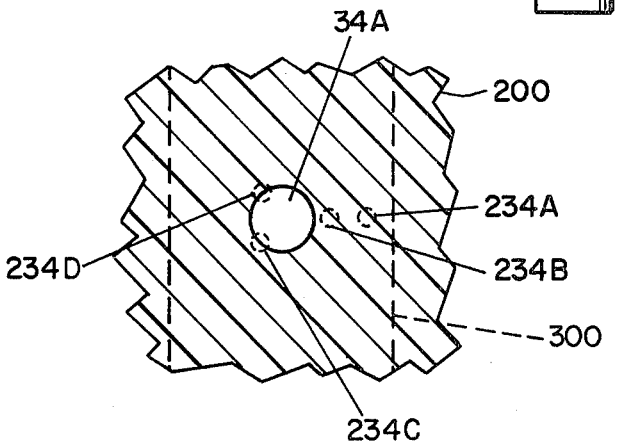
FIG. 5

METERED FUEL INJECTION APPARATUS

Fuel injection with appropriately pressured and timed nozzle means into the respective cylinders of a multi-cylinders engine are becoming increasingly popular for reasons of improved engine performance and economy. Among the several classes of prior art fuel injection systems, the flexing diaphragm divider-wall class has certain recognized advantages, as alluded to in U.S. Pat. Nos. 2,395,330(Houser—Feb. 19, 1946) and 2,989,957(Means—June 27, 1961). In general, this class fuel injection system includes a flexible diaphragm divider-wall separating a fuel-chamber from a hydraulic-chamber, the fuel-chamber being adapted to receive fuel from a fuel-tank, motive hydraulic liquid in the hydraulic-chamber being made to surge against the diaphragm in regular timing with the engine combustion cycle whereby fuel is forced from the fuel-chamber through the nozzle into the engine cylinder. In the prior art patents to Houser and to Means, hydraulic liquid is mechanically surged by mechanical means, such as reciprocating plungers, which has caused problems in controlling the size of each injected fuel batch, in the timing, and in system maintenance. Moreover, the prior art devices do not lend themselves well to fuel-saving "stratified" charges wherein the fuel/air ratio changes within each batch of fuel delivered to the engine cylinder. Commonly, in "stratified" charges, the fuel/air ratio should progressively increase so that very "lean" economical ratios constitute the major proportion of each combustible batch, "richer" ratios being required only immediately adjacent to the detonation means e.g. spark-plug, etc.

It is accordingly the general object of the present invention to provide an improved type fuel metering injection system and apparatus of the flexing diaphragm divider-wall class and which overcomes several disadvantages and deficiencies of prior art systems and structures. It is an ancillary general objective to provide a metered fuel injection system and apparatus of the class described and which are readily adaptable for numerous kinds and designs of multi-cylinders combustion engines and which are also readily amenable to the delivery of "stratified" fuel charges to engine cylinders.

With the above and other objects and advantages in view, which will become more apparent as this description proceeds, the metered fuel injection system of the present invention generally comprises: a housing comprising a plurality of compartments (one for each engine cylinder), each compartment having a diaphragm-like divider-wall to provide two chambers including a fuel-chamber and a hydraulic-chamber, fuel-inlet means (from an exterior fuel-tank) and fuel-outlet means (to a fuel injection nozzle) for the fuel-chamber sub-compartment; a reservoir of motive hydraulic liquid which is pumped in a recirculating path through an inlet-valve into the hydraulic-chamber and thence through an outlet-valve and thence exhausted to the reservoir; said inlet-valve delivering regularly-timed pulses of hydraulic liquid into the respective hydraulic-chambers which flexes the divider-wall into the fuel-chamber thereby delivering a metered fuel batch into the fuel injection nozzle; said outlet-valve affirmatively exhausting the motive hydraulic liquid from the hydraulic-chamber, the outlet-valve chronologically lagging the inlet-valve timing whereby the circulatory hydraulic liquid is exhausted into the reservoir only after a liquid pulsation has flexed the divider-wall to deliver fuel to the injection nozzle; and other desireably implementable features adapted to enhance the performance of the metered fuel injection system.

In the drawing, wherein like characters refer to like parts in the several views, and in which:

FIG. 2 is a top plan view showing the FIG. 1 system embodied into a rudimentary apparatus;

FIG. 3 is a sectional elevational view taken along line 3—3 of FIG. 2;

FIG. 4 is a sectional elevational view of a more sophisticated apparatus according to the system concept of the present invention, and FIG. 5 is a sectional elevational view taken along line 5—5 of FIG. 4.

Figures 1, 1A:
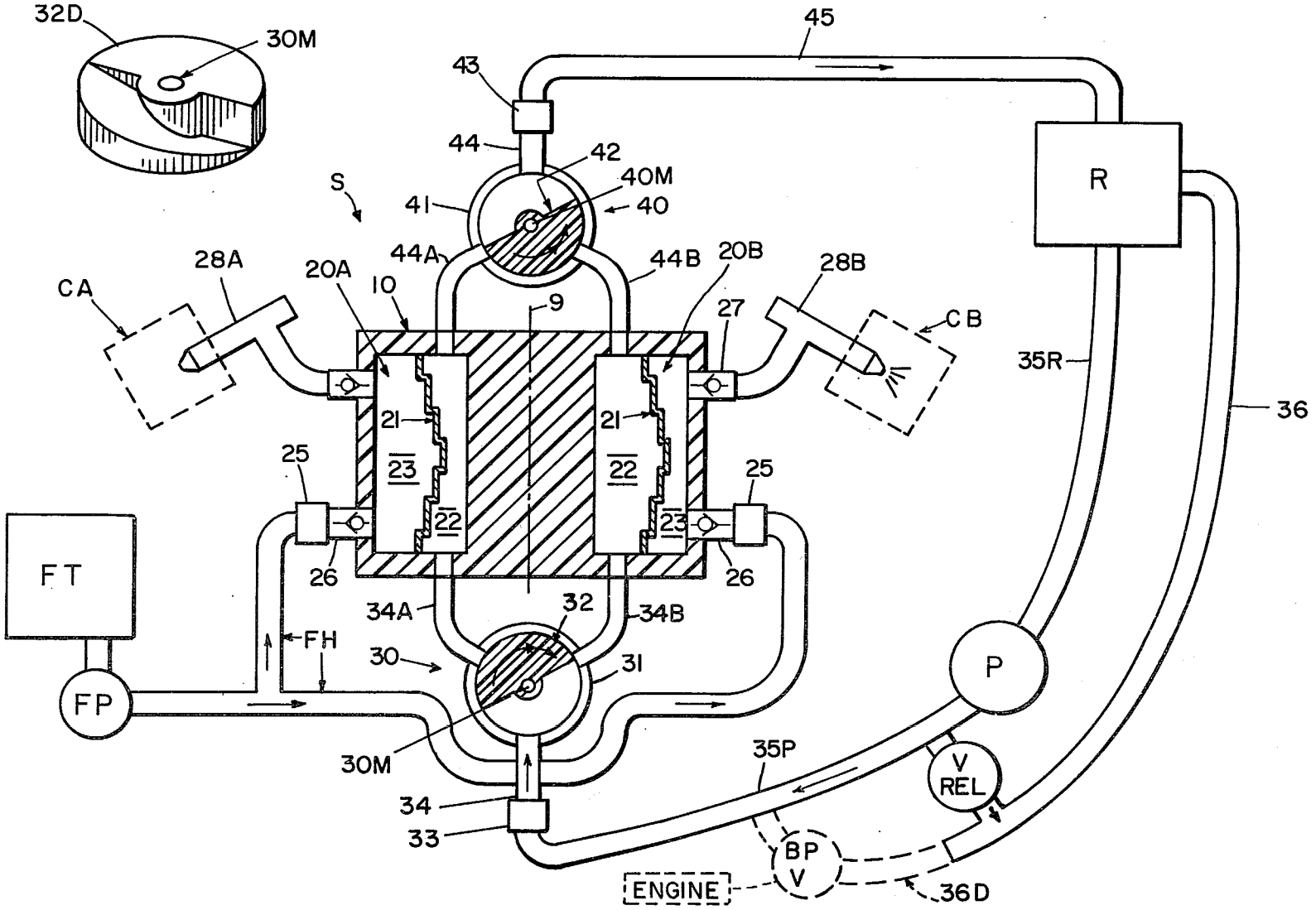
FIG. 1 is a schematic view showing the basic concept for the metered fuel injection system of the present invention.
FIG. 1A is a perspective view of an apt inlet-valve which might be optionally employed for delivering a "stratified" type fuel charges.

The FIG. 1 schematic view will provide an understanding of the novel fuel injection system of the present invention. The overall system "S" is intended to sequentially inject metered fuel from a fuel-tank "FT" (as via fuel-pump "FP") into the respective combustion cylinders of a multi-cylinders engine and each cylinder having a special fuel injection nozzle thereat. For convenience of illustration, two sets of engine cylinders and nozzles are arbitrarily shown, "CA"(with nozzle 28A) and "CB"(with nozzle 28B); however, the system "S" is also analagously adaptable for additional sets of engine cylinders and nozzles. There is a reservoir "R" of motive hydraulic liquid, preferably oil, stored at a reservoir-pressure which is of a relatively low and constant finite value. There is a pumping means, such as rotary pump "P," adapted to deliver the hydraulic liquid from the return reservoir "R" along a supply-line (e.g. 35R and 35P) to an inlet-valve 30 whereat the hydraulic liquid pressure attains a finite-input-pressure which is of a value exceeding reservoir-pressure. Conventionally, there might be a pressure-relief valve "V-REL" positioned downstream of pump "P" and tieing supply-line portion 35P to a bypass-line 36 leading directly into reservoir "R."

There is a plurality of fuel-chambers, one for each engine cylinder (such as fuel-chamber 23A for 28A and "CA," and 23B for 28B and "CB"), the fuel-chambers 23 being at the periphery of upright stationary housing 10 which has a vertical-axis 9. In this vein, housing 10 defines a plurality of compartments, one for each engine cylinder and its fuel chamber 23, such as compartment 20A for 23A and "CA," compartment 20B for 23B and "CB," etc. Each of said compartments 20 is equipped with an upright semi-rigid diaphragm-like divider-wall 21 which wall is impervious to the hydraulic liquid and to the fuel and which defines two distinct chambers for compartments 20 including a hydraulic-chamber 22 and a fuel-chamber 23. There are fuel-inlet means communicating from the fuel-tank "FT" through fuel-hoses "FH" and an incoming-checkvalve 26 to the respective fuel-chambers 23. Preferably, a removable connection 25 is afforded between the elongate fuel-lines "FH" and the fuel-pump "FP." There are fuel-outlet means communicating from each fuel-chamber 23 through an outgoing-checkvalve 27 to the fuel injection nozzle 28.

Liquid-inlet means communicate from toward the pumping means "P" to each hydraulic-chamber 22. Herein, tubular inlet-liquid means 34 commences at a removable connection 33 for supply-line segment 35P, thence proceeds into inlet-valve 30 and thence proceeds in two branches 34A and 34B into the respective hydraulic-chambers 22. Similarly, liquid-outlet means communicate from the respective hydraulic-chambers 22 toward reservoir "R." Herein, tubular liquid-outlet means 44 commences at a removable connection 43 for exhaust-hose 45, thence proceeds into outlet-valve 40 and thence proceeds in two branches 44A and 44B into the respective hydraulic-chambers 22.

The inlet-valve means 30 is capable of delivering regularly-timed pulses of motive hydraulic liquid at said input-pressure into 34 and thence through 44 the respective hydraulic-chambers 22. These liquid pulses cause regularly-timed deliveries of fuel to the fuel injection nozzles 28 by regularly-timed flexures of divider-walls 21 convexly into fuel-chambers 23. Chronologically lagging each convex flexure of a divider-wall 21 into a fuel-chamber 23 (which delivers fuel through outgoing-checkvalve 27 and nozzle 28), the outlet-valve means 40 exhausts a volumetrically similar pulse of hydraulic liquid along the liquid-oulet means 44 into the remote reservoir "R." When this happens, divider-wall 21 flexes (as by spring pressure) convexly into a hydraulic-chamber 22 and fuel enters fuel-chamber 23 through an incoming-checkvalve 26, which is later delivered through outgoing-checkvalve 27 when another liquid pulse from inlet-valve 30 again flexes divider-wall 21 convexly into fuel-chamber 23. As arbitrarily depicted in FIG. 1, nozzle 28B has just delivered a fuel batch into engine cylinder "CB" and the rotor 32 of inlet-valve 30 has just closed liquid-inlet branch 34B, and the rotor 42 of outlet-valve 40 is exhausting the hydraulic liquid along branch 44B into reservoir "R" which will allow divider-wall 21 to convexly flex into hydraulic-chamber 22 from 23B. Coincidentally, rotor 32 begins to deliver a pulse of hydraulic liquid from 34 into branch 34A which will flex divider-wall 21 into fuel-chamber 23A to deliver a fuel batch through outgoing-checkvalve 27 to nozzle 28A. The aforedescribed process is repeated according to a regularly-timed sequence. As has been alluded to, the inlet-valve 30 and the outlet-valve 40 are preferably of the rotary valves types such as comprising the rotors 32 and 42 which are co-revolvable with their respective shafts 30M and 40M.

FIGS. 2 and 3 illustrate that system "S" of FIG. 1 might be embodied into an apparatus "AA" comprising a single housing 100 which includes therewithin both rotors 32 and 42 having a common rotary driving shaft "M" extending along vertical-axis 9. The fixed angular positions of rotors 32 and 42 on shaft "M" determine the regular-timing of delivery into and subsequent exhaustion from the respective hydraulic-chambers 22. Housing 100 might be stationarily attached to the environment of the multi-cylinders engine (e.g. "CA" and "CB" with mounting flanges 101. In this vein, apparatus housing 100 might be removably connected to the environment with three elongate hoses including: exhaust-hose 45 removably connected to coupling 43, fuel-hose "FH" removably connected to couplings 25, and supply-line segment 35P removably connected to coupling 33. The liquid-inlets (34, 34A, and 34B) and the liquid-outlets (44, 44A, and 44B) are includable as machined passageways within housing 100.

It is sometimes desireable to deliver a so-called "stratified" fuel charge into the respective engine cylinders through the nozzles 28. A "stratified" fuel charge is generally defined to mean a fuel batch which is "leaner" at the beginning and "richer" at the end of the engine intake stroke whereby the "richer" portion is nearer the cylinder detonator means (e.g. spark-plug) and whereby fuel economy over the engine running cycle tends to result. An apt means of delivering such "stratified" fuel batches involves the specially tapered contour rotor 32D shown in FIG. 1A, which rotor ensures that within each liquid-initiated pulse of fuel there is progressively more hydraulic liquid delivered into hydraulic-chamber 22 (and hence too, fuel to nozzle 28) by the inlet-valve rotor 32D. For such progressively sloping delivery of hydraulic liquid into the liquid-inlet means 34, it must be ensured that at progressively higher engine speeds a lower proportion of the pump means "P" displacement capacity re-enters the bypass-line 36 to reservoir "R." In this vein, bypass-line 36, downstream of the pressure-relief valve "V-REL," comprises a tubular extension 36D which communicates with supply-line segment 35P between "V-REL" and coupling 33. A variable capacity bypass-valve "BP-V" is interposed along bypass-line extension 36D, the flow-through capacity of "BP-V" being made controllably proportional to the engine speed, for example as by operatively tying "BP-V" to the engine accelerator pedal (not shown).

FIG. 4 shows a more sophisticated apparatus "AAA," yet based upon the operating principle of Apparatus "AA" of FIGS. 2 and 3. Apparatus "AAA" comprises a metallic housing 200 having various machined passageways and a rotary bivalve 300 that is performing the combination of functions as has done the inlet-valve means 30 and the outlet-valve means 40. It will be noted that the machined passageways inside housing 200 accommodate the incoming-checkvalves 26 and the outgoing-checkvalves 27, and also the following peripheral couplings: 43 (for exhaust-hose 45), 25 (for fuel-hose "FH"), 33 (for supply-line 35), nipple 205 for bypass-line 36, and for the fuel injection nozzles 28. Herein, the pump means is illustrated as a gear pump "PG" which is co-revolvable with shaft "MM" and located within housing 200, and a spring-loaded pressure-relief valve "V-REL" is also located inside housing 200. The housing interior passageways also include an annular extension 204 of fuel-line "FH", a bypass-line extension 36D, both the initial portion 34 and the branches 34A and 34B of the liquid-inlet means, and the initial branches 44A and 44B and the terminus 44 of the liquid-outlet means. Spring-loaded pressure-relief valve "V-REL" is located inside housing 200 between passageways 34 and 36D. Diaphragm-like divider-wall 21 is spring-loaded 60 which bears against a threaded socket 210 which defines the respective fuel-chambers 23. On the inward side of divider-walls 21, and partially defined by the tubular-stop 70 for the divider-wall 21, is the hydraulic-chamber 22.

Bivalve 300 performs the dual functions of inlet-valve means 30 and outlet-valve means 40. Bivalve 300 is a monolithic one-piece structure (co-revolvable with rotary shaft "MM", and herein driven at "MD") having internal machined passageways such as 234 spaced to register with the liquid-inlet initial 34 and branches 34A and 34B, and such as 244 spaced to register with the liquid-outlet branches 44A and 44B and terminus 44, all in accordance with the engine regular-timing heretofore described in conjunction with FIGS. 1–3. Moreover, as indicated in FIG. 5, stratified fuel batches might be attained when the bivalve liquid-inlet portion 234 comprises judiciously spaced terminal holes (e.g. 234A–234D). This is an alternate means compared to that of FIG. 1A. As was previously alluded to, the position of bypass-valve "BP-V" is dependent upon the engine running speed, and for example might be controllably tied to a depressible accelerator pedal (not shown).

From the foregoing, the construction and operation of the metered fuel injection system and apparatus will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. A metered fuel injection apparatus for sequentially injecting metered fuel from a fuel-tank into the respective combustion chambers of a multi-cylinder engine and each cylinder having its own fuel injection nozzle, said apparatus being removably connectable with elongate hoses respectively leading into a reservoir of motive hydraulic liquid stored at a finite reservoir-pressure value, a fuel-hose to said fuel-tank, and also a supply-line from a pumping means for delivering hydraulic liquid from the reservoir at input-pressure which exceeds reservoir-pressure, said apparatus comprising:

A. an upright housing surrounding an upright rotary shaft lying along a vertical-axis and comprising a plurality of compartments spaced at regular angular increments around said shaft, each compartment being equipped with a single upright fluid-impervious semi-rigid diaphragm-like barrier defining two subcompartments including firstly a fuel-chamber and secondly a single hydraulic-chamber extending continuously and without interruption both to a rotary inlet-valve and to a rotary outlet-valve, fuel-inlet means and incoming checkvalve communicating between the fuel-chambers and the fuel-hose, fuel-outlet means communicating from each fuel-chamber through an outgoing check-valve to a said fuel injection nozzle, liquid-outlet means communicating from the respective hydraulic-chambers to said exhaust-hose, and liquid-inlet means regularly angularly spaced about said shaft and communicating from said inlet-valve to each hydraulic-chamber;

B. said rotary type inlet-valve being co-rotatational with said upright rotary shaft and located within said housing at the juncture of the supply-line and the angularly spaced liquid-inlet means whereby said inlet-valve is capable of delivering regularly-timed pulses of motive hydraulic liquid at input-pressure through said liquid-inlet means sequentially into the said hydraulic-chambers and whereby the respective divider-walls sequentially flex into the fuel laden fuel-chamber to deliver a metered fuel batch through said outgoing check-valve and its nozzle; and C. said rotary type outlet-valve being co-rotational with said upright rotary shaft and located within said housing in vertical alignment with but angularly lagging the inlet-valve, said lagging outlet-valve being at the liquid-outlet means thereby being capable of exhausting motive hydraulic liquid from said hydraulic-chamber at less than input-pressure along said liquid-outlet means into the reservoir after the divider-wall diaphragm has already delivered a fuel batch to the injection nozzle.

2. The apparatus of of claim 1 wherein there is a bypass-line paralleling the supply-line and bypassing the pump means; and wherein there is a variable capacity bypass-valve interposed along the bypass-line and which capacity is directly dependent upon the engine running speed.

3. The apparatus of claim 1 wherein there is a bypass-line paralleling the supply-line and bypassing the pump means; and wherein there is a variable capacity bypass-valve interposed along the bypass-line and which capacity is made directly dependent upon the engine running speed.

4. The apparatus of claim 3 wherein both the inlet-valve and the outlet-valve are together of a monolithic metallic rotary bivalve construction that is co-rotatable with the upright shaft and includes internal passageways spaced to register with the liquid-inlet and the outlet-liquid means according to engine regular-timing.

5. The apparatus of claim 4 wherein the housing is provided with internal passageways to provide at least a portion of: the liquid-inlet means, the liquid-outlet means, the supply-line, and the bypass-line; wherein at least a portion of the bypass-line, the bypass-valve, the pump means, and the spring-loaded pressure-relief valve are all located within said housing; and wherein the liquid-inlet passageway of the bivalve includes a plurality of appropriately irregularly spaced terminal holes to deliver a stratified fuel batch to the fuel injection nozzle.

6. The apparatus of claim 1 adaptable for delivering a stratified fuel batch through the outgoing-checkvalve and the fuel injection nozzle and wherein the fuel stratified batch is dependent upon the intra-pulse rate that the inlet-valve delivers hydraulic liquid into the hydraulic-chamber; and wherein the inlet-valve and the outlet-valve rotate at a substantially constant angular velocity.

7. The apparatus of claim 6 wherein the inlet-valve rotor is maintained at a constant elevation of the upright housing and is generally circular with a tapering helical external contour thereby providing a stratified fuel batch to the fuel injection nozzle.

8. The apparatus of claim 1 wherein the housing is provided with internal passageways to provide at least a portion of: the liquid-inlet means, the liquid-outlet means, the supply-line, and the bypass-line; and wherein at least the bypass-line, the bypass-valve, and the pump means are all located within the said housing.

* * * * *